US006036603A

United States Patent [19]

Mason et al.

[11] Patent Number: 6,036,603

[45] Date of Patent: Mar. 14, 2000

[54] WHIRLPOOL SIMULATION EFFECT

[75] Inventors: William D. Mason; Jonathan D. Frank, both of Orlando, Fla.; Risto M. Salo, Valencia, Calif.

[73] Assignee: Universal Studios, Inc., Universal City, Calif.

[21] Appl. No.: 09/162,964

[22] Filed: Sep. 29, 1998

[51] Int. Cl.[7] ..... A63G 31/00

[52] U.S. Cl. ..... 472/65; 472/82

[58] Field of Search ..... 472/13, 59, 60, 472/61, 67, 117, 82, 128, 65; 405/79, 52, 21; 239/17, 23

[56] References Cited

U.S. PATENT DOCUMENTS

| | | | |
|---|---|---|---|
| 159,959 | 2/1875 | Parker . | |
| 490,490 | 1/1893 | Mackaye . | |
| 883,485 | 3/1908 | Ridgway . | |
| 1,019,405 | 3/1912 | Atwood . | |
| 1,076,779 | 10/1913 | Miller et al. . | |
| 2,268,932 | 1/1942 | Gatewood | 472/82 |
| 2,301,267 | 11/1942 | Gatewood | 272/17 |
| 3,613,264 | 10/1971 | Vitka et al. | 35/19 |
| 3,913,332 | 10/1975 | Forsman | 61/1 |
| 4,002,333 | 1/1977 | Gotoh | 272/8 |
| 4,258,912 | 3/1981 | Reighart . | |
| 4,792,260 | 12/1988 | Sauerbier | 405/79 |
| 4,836,521 | 6/1989 | Barber | 272/32 |
| 4,905,987 | 3/1990 | Frenzi | 272/17 |
| 5,096,467 | 3/1992 | Matsui . | |
| 5,171,101 | 12/1992 | Sauerbier et al. | 405/79 |
| 5,213,547 | 5/1993 | Lochtefeld | 472/119 |
| 5,271,692 | 12/1993 | Lochtefeld | 405/79 |
| 5,387,159 | 2/1995 | Hilgert et al. . | |
| 5,433,671 | 7/1995 | Davis | 472/117 |
| 5,453,196 | 9/1995 | Tuszko . | |
| 5,482,510 | 1/1996 | Ishii et al. | 472/61 |
| 5,503,597 | 4/1996 | Lochtefeld et al. | 472/128 |
| 5,556,340 | 9/1996 | Bohn et al. | 472/59 |
| 5,616,083 | 4/1997 | Subbaraman et al. | 472/67 |
| 5,628,584 | 5/1997 | Lochtefeld | 405/79 |
| 5,738,590 | 4/1998 | Lochtefeld | 472/117 |
| 5,899,634 | 5/1999 | Lochtefeld | 405/79 |

*Primary Examiner*—Kien T. Nguyen
*Attorney, Agent, or Firm*—Lyon & Lyon LLP

[57] ABSTRACT

In an apparatus and method for creating a wave or water vortex effect, a bridge or platform is positioned within a semi-cylinder having a downward facing curved inside surface. Nozzles shoot water onto the curved surface, creating a water layer which follows the curved surface up and around the semi-cylinder. The water layer remains against the curved surface via centrifugal force. A spiral flow path is created by declining the semi-cylinder.

19 Claims, 10 Drawing Sheets

Fig. 8
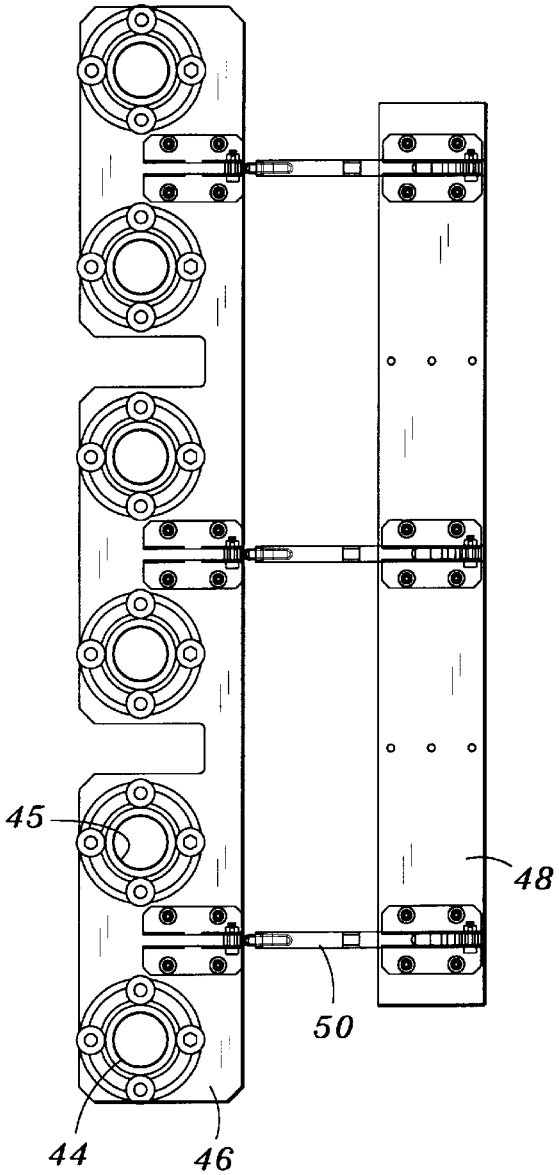
Fig. 7
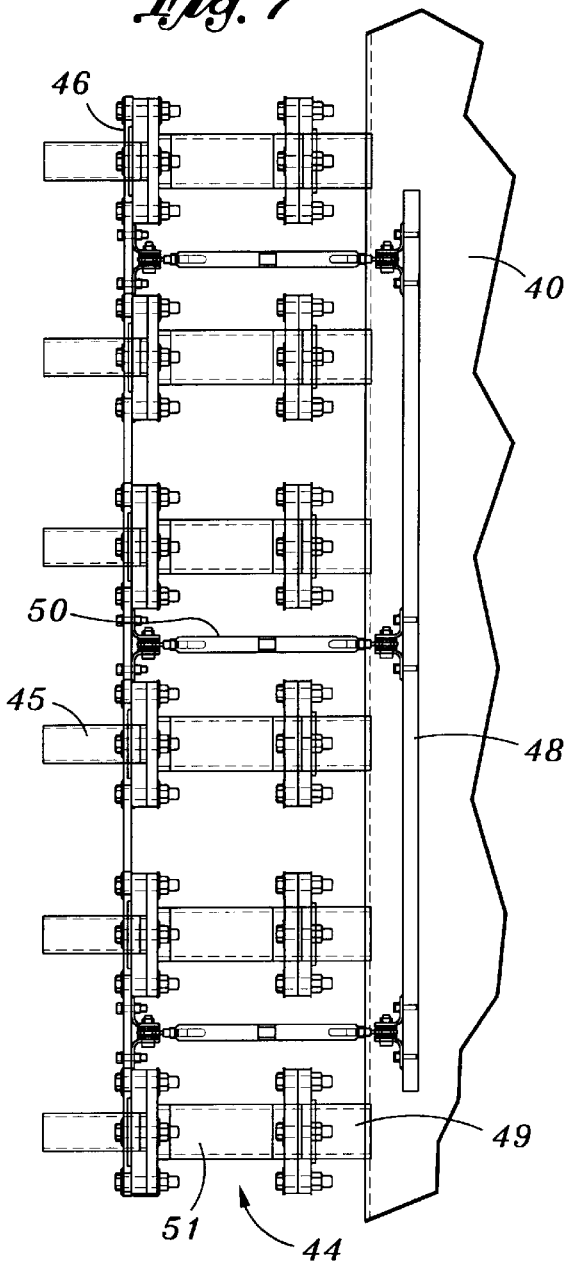
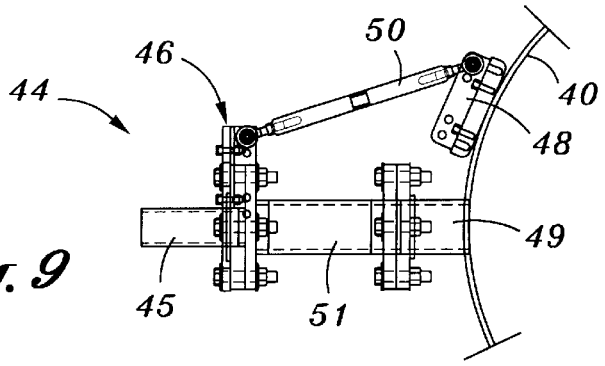
Fig. 9

WHIRLPOOL SIMULATION EFFECT

FIELD OF THE INVENTION

The field on the invention is simulations and effects used in amusement parks.

BACKGROUND OF THE INVENTION

For many years, amusement parks have often included walk-through attractions, in addition to rides, tours, live-action shows, and other types of attractions. In walk-through attractions, patrons or guests typically walk along a path. Scenery, fixed and moving props and animated figures, and various special sound, visual and environmental effects along the path entertain the park guests. Walk-through attractions often have a theme connecting the attraction to a well known motion picture or television program, comic book or cartoon characters, or specific historical events.

While existing walk-through attractions have met with varying degrees of success, there remains a need for a walk-through attraction having more dramatic and entertaining features. Indeed, the public has come to expect amusement or theme parks to provide increasingly sophisticated and creative rides and attractions.

Walk or ride-through attractions have used various water effects, such as waterfalls, waves, fountains, whirlpools, etc. These types effects and especially whirlpool effects, have largely been provided at some distance from the park guests. However, the inventors have now conceived of an amusement park attraction, such as a walk-through or ride-through attraction, wherein park guests experience being within a whirlpool.

SUMMARY OF THE INVENTION

In a first aspect of the invention, an attraction has a tunnel with a curved inside surface. A platform is provided in the tunnel. Water shoots onto the curved inside surface of the tunnel at high speed. The water moves up, over and down the curved inside surface. Centrifugal force maintains the water against the curved inside surface, even at the top of the tunnel where the curved inside surface faces downwardly. Park guests move through the tunnel, e.g., by walking on the platform or riding on a vehicle over the platform, and are substantially surrounded by moving water. The attraction creates the effect of being within a whirlpool.

In a second and separate aspect of the invention, the tunnel is inclined at an angle. The water streaming along the curved inside surface of the tunnel moves downwardly through the tunnel, in a spiral pattern, similar to the movement of a whirlpool.

In a third and separate aspect of the invention, substantially concealed lighting fixtures extend along the platform. The lighting fixtures shine light downwardly onto the platform, to illuminate the inside of the tunnel, without detracting from the whirlpool effect created.

In a fourth and separate aspect of the invention, water is provided to a manifold extending parallel to the tunnel. Spaced apart nozzles on the manifold shoot water at one side of the curved inside surface. The water runs up the surface, over the top of the tunnel, and then down the other side to a drain leading back to a reservoir.

Accordingly, it is an object of the invention to provide an improved walk-through or ride-through attraction for an amusement park.

It is also an object of the invention to provide a whirlpool effect for use in amusement parks, in motion picture filming, or in other swirling water effect applications.

BRIEF DESCRIPTION OF THE DRAWINGS

Other objects and features of the invention will become apparent from the following detailed description taken in connection with the accompanying drawings. It should be understood, however, that the drawings are provided for the purpose of illustration only, and are not intended as a definition of the limits of the invention.

In the drawings, wherein the same reference number denotes the same element, throughout the several views:

FIG. 7 is a developed plan view of the nozzles shown in FIGS. 5 and 6;

FIG. 8 is a developed end view thereof;

FIG. 9 is a rotated end view thereof;

DETAILED DESCRIPTION OF THE PREFERRED EMBODIMENTS

Figure 1:
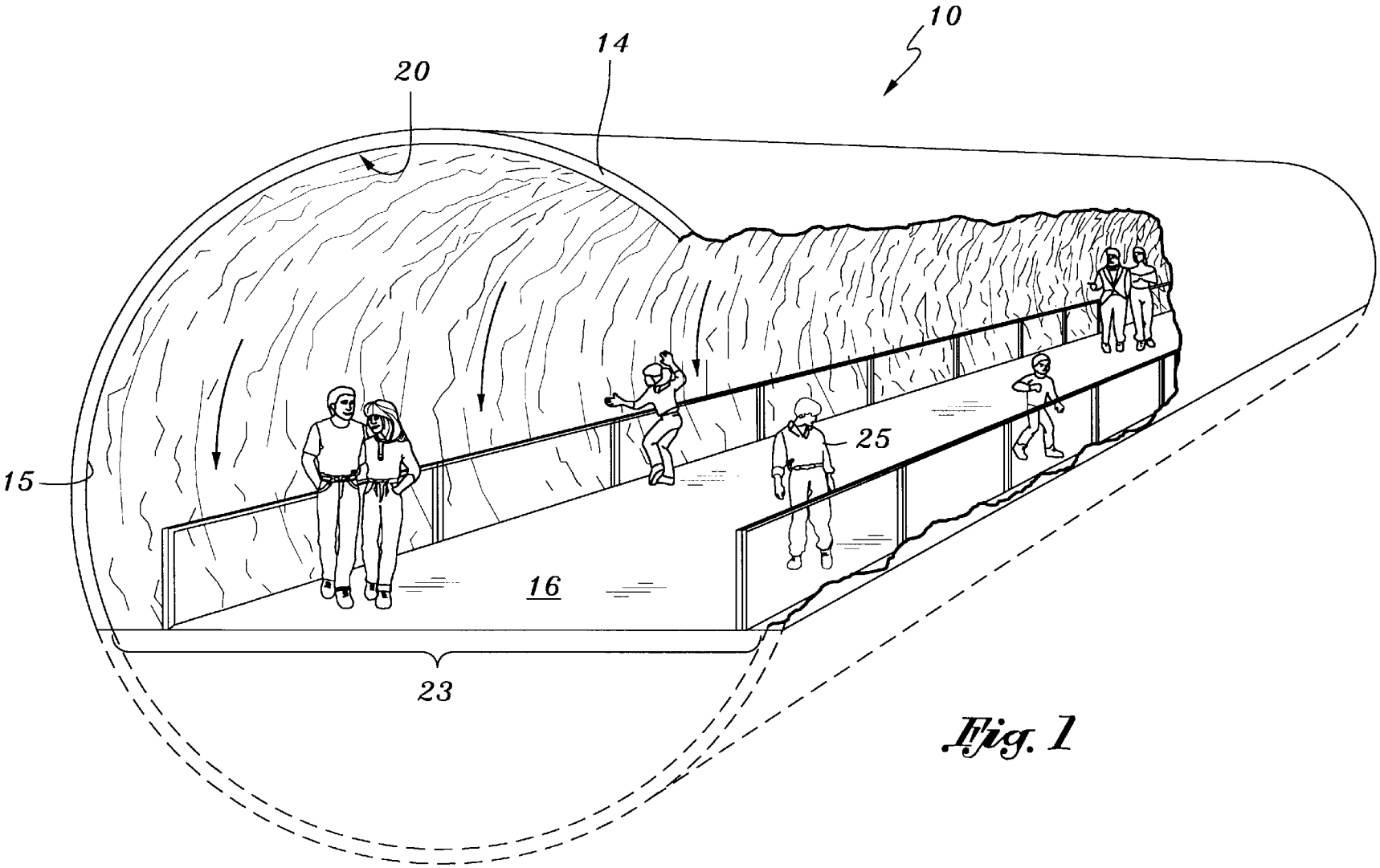
FIG. 1 is a perspective view of the wave effect of the present invention.
Figure 2:
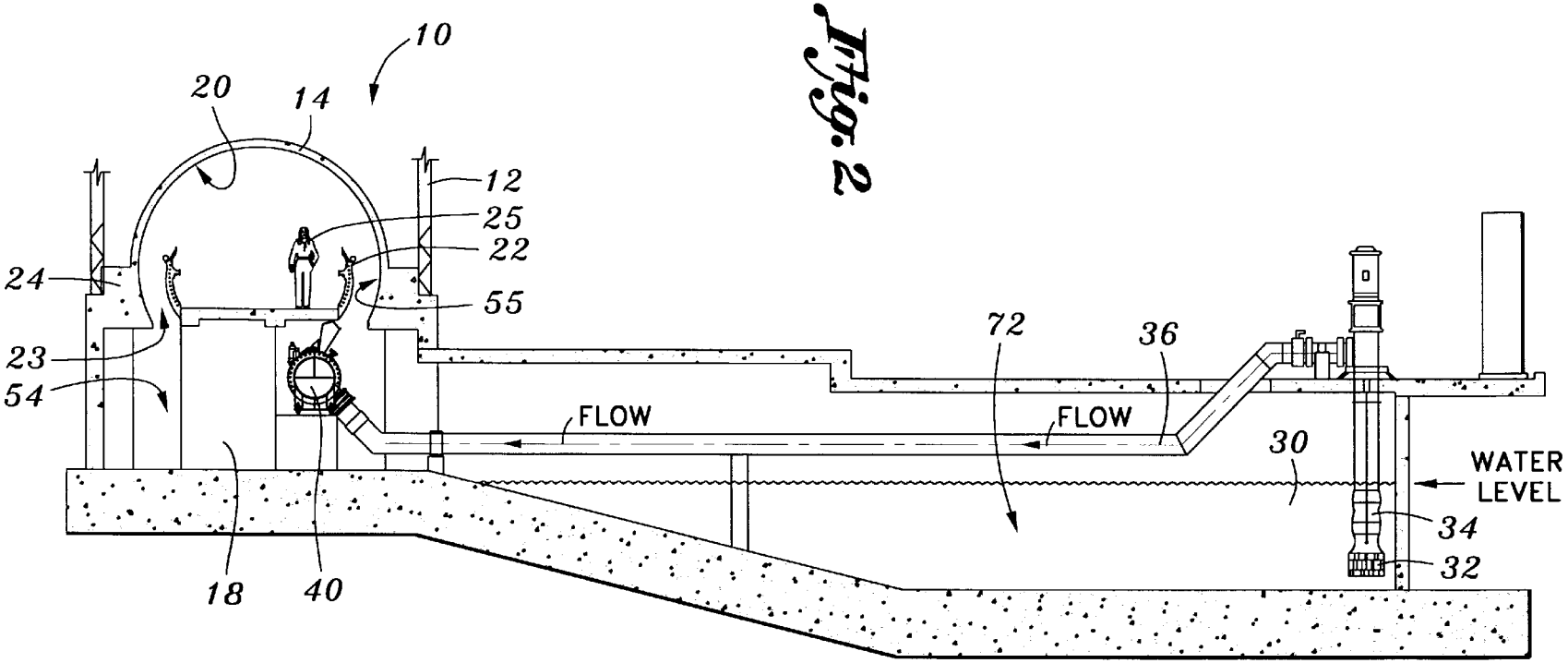
FIG. 2 is a section view of a preferred installation of the wave effect invention shown in FIG. 1.
Figure 3:
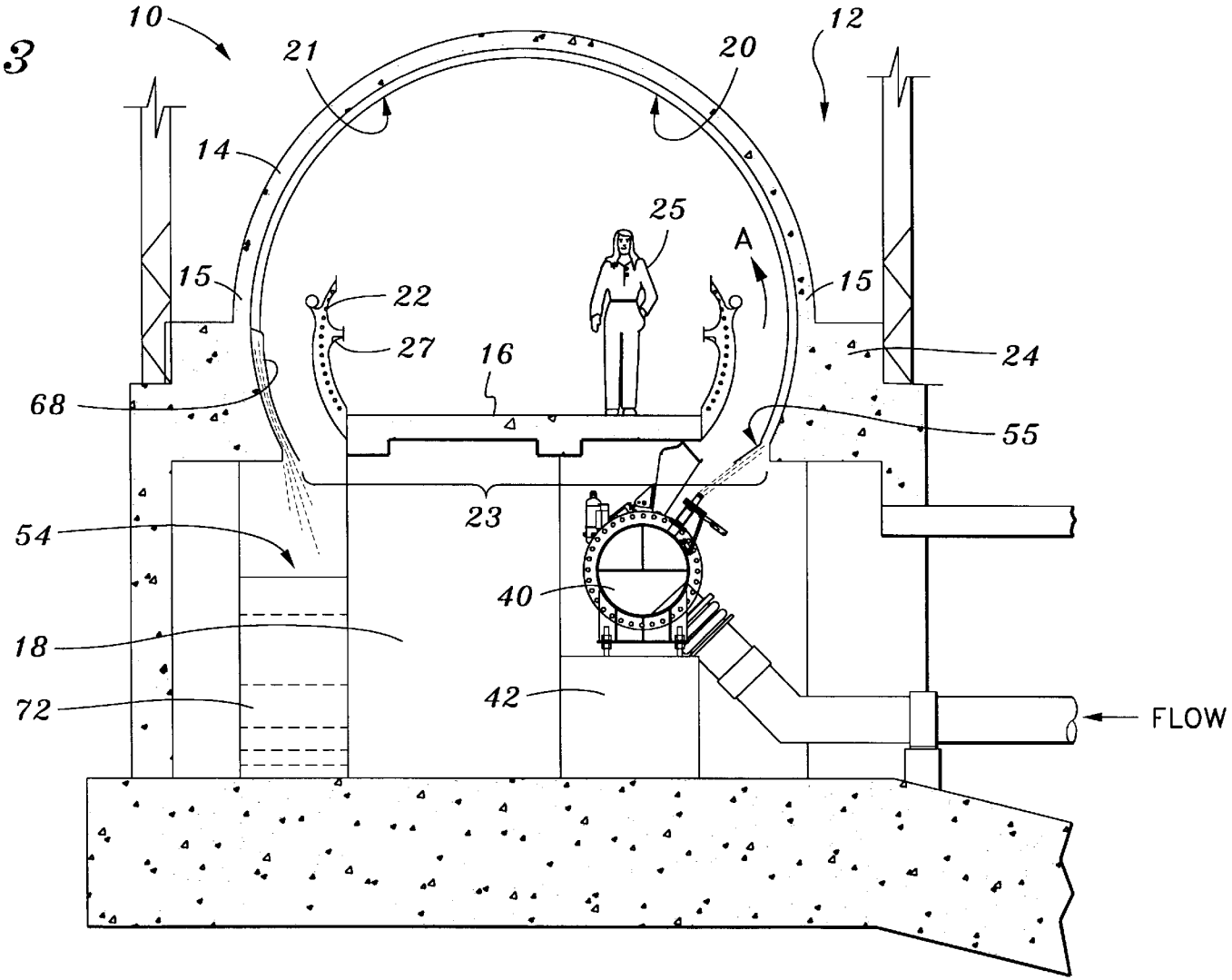
FIG. 3 is an enlarged section view of the wave effect shown in FIGS. 1 and 2.

Turning now in detail to the drawings, as shown in FIGS. 1–3, an attraction 10 within a themed building 12 has a bridge or platform 16 extending through a tunnel 14. The tunnel 14 is a semi-cylinder preferably open on the bottom. The tunnel extends over an arc of from about 180–270°, and preferably 220°. The radius of the tunnel (from the tunnel center to the curved inside tunnel wall or surface 20) preferably ranges from 200–300 cm., preferably about 275 cm. The tunnel 14 has a length to diameter ratio of from 1:1 to 20:1, and preferably about 5:1. As shown in FIG. 3, the bridge or platform 16 is supported on a base 18, which is ordinarily not visible to a theme park guest 25 walking on the bridge 16. The downward-facing opening 23 of the tunnel 14 is below the top surface of the bridge 16. The bridge 16 is spaced apart from the side walls 15 of the tunnel 14. The tunnel 14 is supported on a floor or foundation 24 of the building 12.

Handrails 22 extend along both sides of the bridge 16. Lighting fixtures 27 in the handrails 22 project light downwardly onto the bridge 16, and outwardly onto the inside tunnel wall or surface 20.

Referring to FIG. 2, a reservoir 30 is provided near the tunnel 14. Pumps 34 at or in the reservoir 30 draw in water 72 through inlets 32. The water 72 is pumped through supply pipes 36 to a manifold 40 under the tunnel 14.

Figure 5:
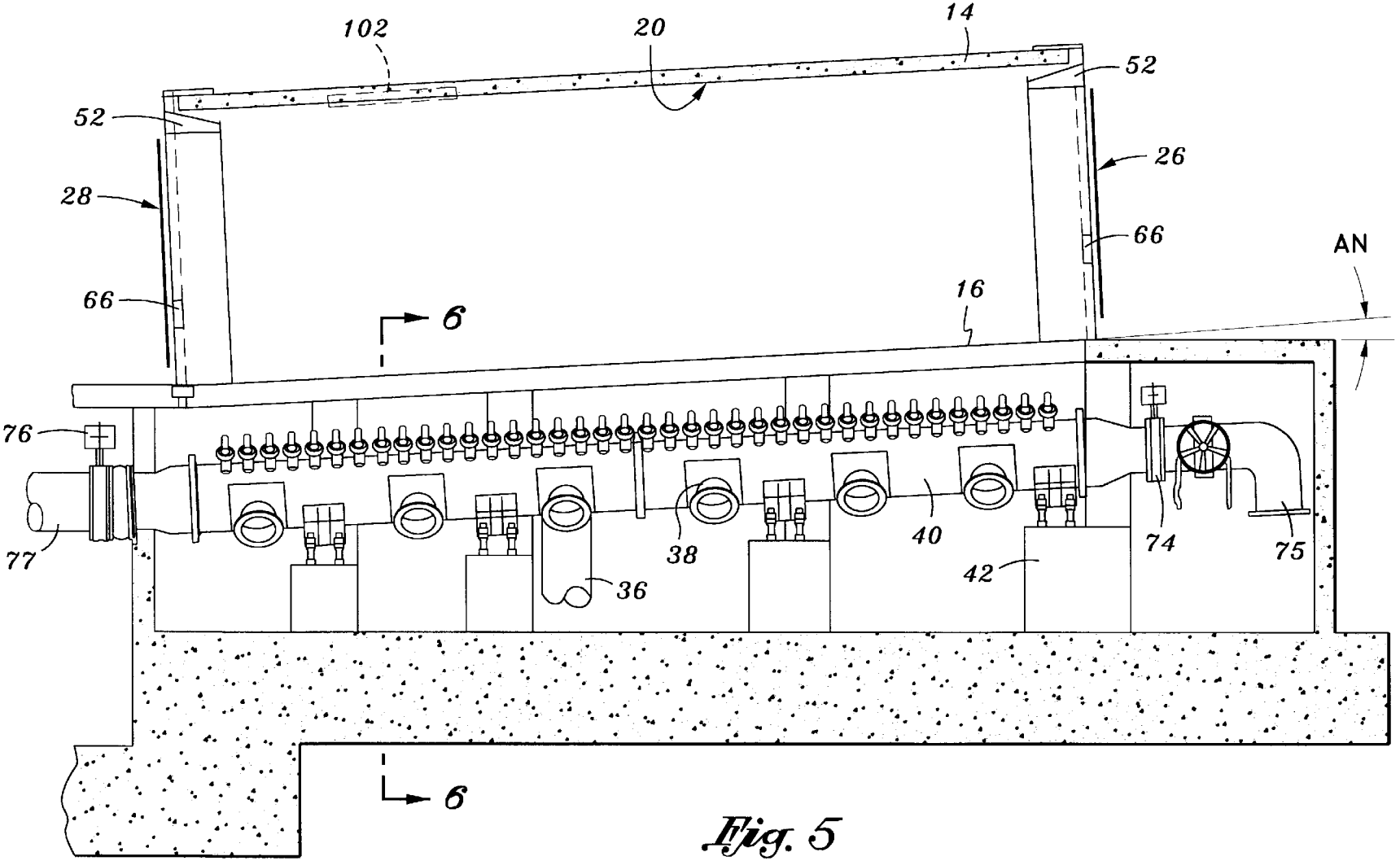
FIG. 5 is a side elevation view, in part section, of the wave effect shown in FIG. 1.
Figure 6:
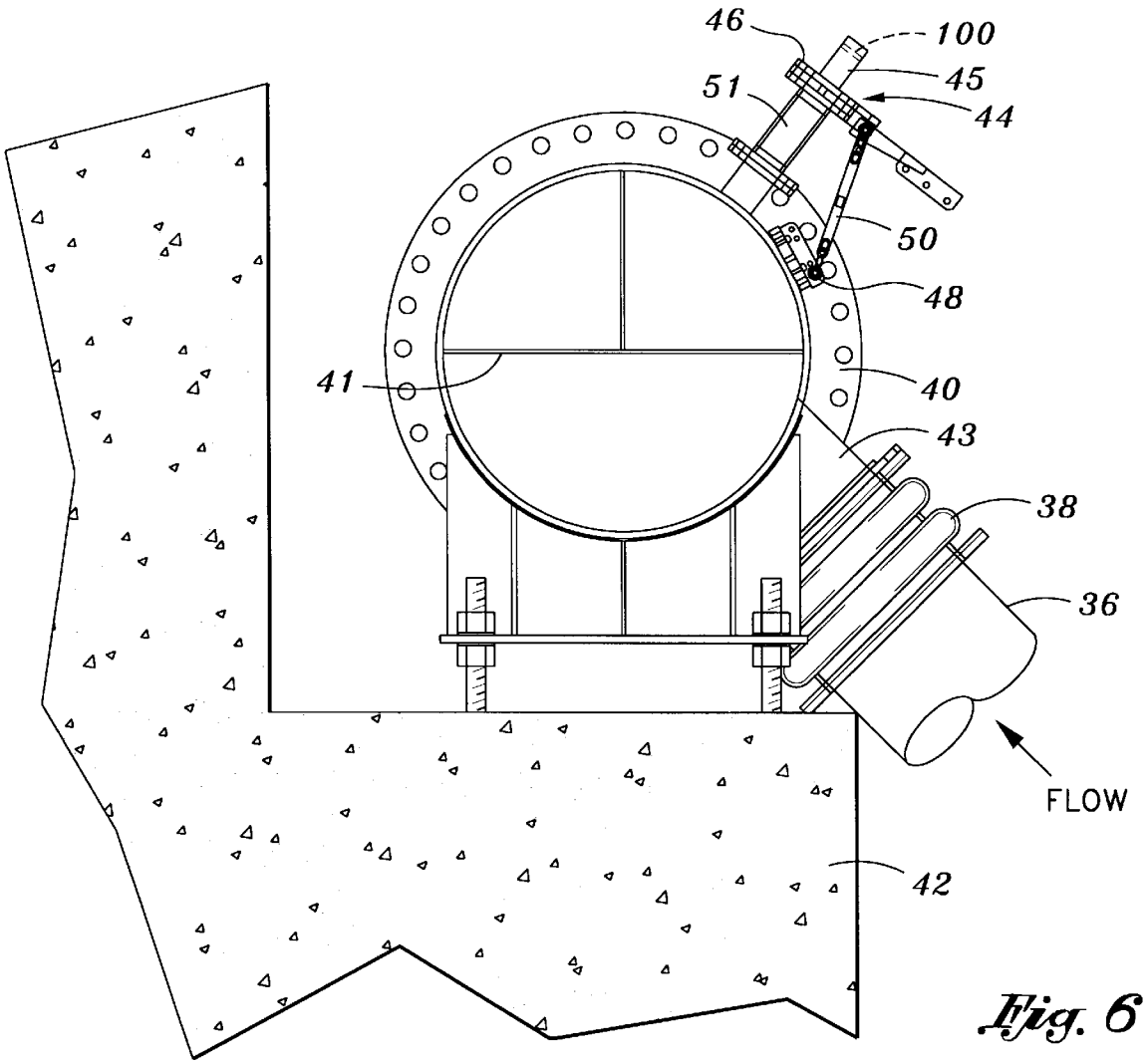
FIG. 6 is an enlarged section view taken along line 6—6 of FIG. 5.

Referring to FIGS. 5 and 6, the manifold 40 extends along the length of the tunnel 14, supported on manifold supports 42. The tunnel 14 and manifold 40, in the preferred embodiment, are about 12 meters long. The manifold 40 is preferably provided in two 6 meter sections attached together at a flange joint 45 and the manifold inside diameter is about 90 cm. In this preferred embodiment, six pumps 34 provide water 72 from the reservoir 30, through six supply pipes 36 leading into the manifold 40. The supply pipes 36 are joined to a flexible coupling 38 on manifold inlets 43.

Referring to FIGS. 6–9, nozzles 44 are spaced apart (at about 30 cm.) along the length of the manifold 40. Six nozzles 44 are mounted on a nozzle plate 46. Nozzle position adjusters 50 extend between a brace plate 48 attached to the outside surface of the manifold 40, and to the nozzle plate 46.

Each nozzle 44 includes a nozzle end pipe 45 having an inside diameter of about 5 cm. The end pipes 45 are joined to nozzle stubs 49 via flexible couplings 51. Consequently, the elevation angle for aim of the nozzle ends 45 can be adjusted by turning the adjusters 50. During initial installation, the adjusters 50 are turned to aim the nozzles 44 to achieve the optimum water vortex 68 within the tunnel 14. As shown in FIG. 6, baffles 41 within the manifold 40 stabilize the water flow and prevent water 72 pumped in through the manifold inlets 43 from flowing directly out of the nozzles 44. The baffles 41 are centered over the manifold inlets 43, to slow down the water entering the manifold 40.

Referring to FIGS. 2 and 5, end gutters 52 are provided at the entrance 26 and exit 28 of the tunnel 14. A drain opening 54 alongside the base 18 below the tunnel 14 extends back down into the reservoir 30. Circumferential fog generators 66 are optionally provided at the entrance 26 and exit 28 of the tunnel 14.

In use, the pumps 34 are switched on and pump water 72 from the reservoir 30 into the manifold 40. The water 72 under pressure within the manifold 40 shoots out of the nozzles 44, to an impact area 55 of the tunnel 14 (at the right side wall 15 in FIG. 3). The water 72 travels upwardly (in a direction of arrow A in FIG. 3) and around the entire semi-cylindrical inside tunnel surface 20, and then into the drain opening 54. The water 72 collecting below the tunnel 14 and walkway 16 flows under gravity back to the reservoir 72. The water 72 is pumped through the nozzles 44 at a sufficiently high velocity that the water remains against the inside tunnel surface 20 via centrifugal force. Hence, even at the top inside surface 21 of the tunnel 14, the water 72 does not fall or drip down onto the bridge 16 and guests 25. Consequently, the guests 25 perceive that they are inside of a curling wave or water vortex. The nozzle dimensions and arrangement create a continuous, moving layer of water 68 having a thickness in the range of 1–6 cm., and preferably about 3 cm. The tunnel is preferably made of strong and durable materials to resist the substantial impact and inertial forces generated by the rapidly moving water 72.

Figure 4:
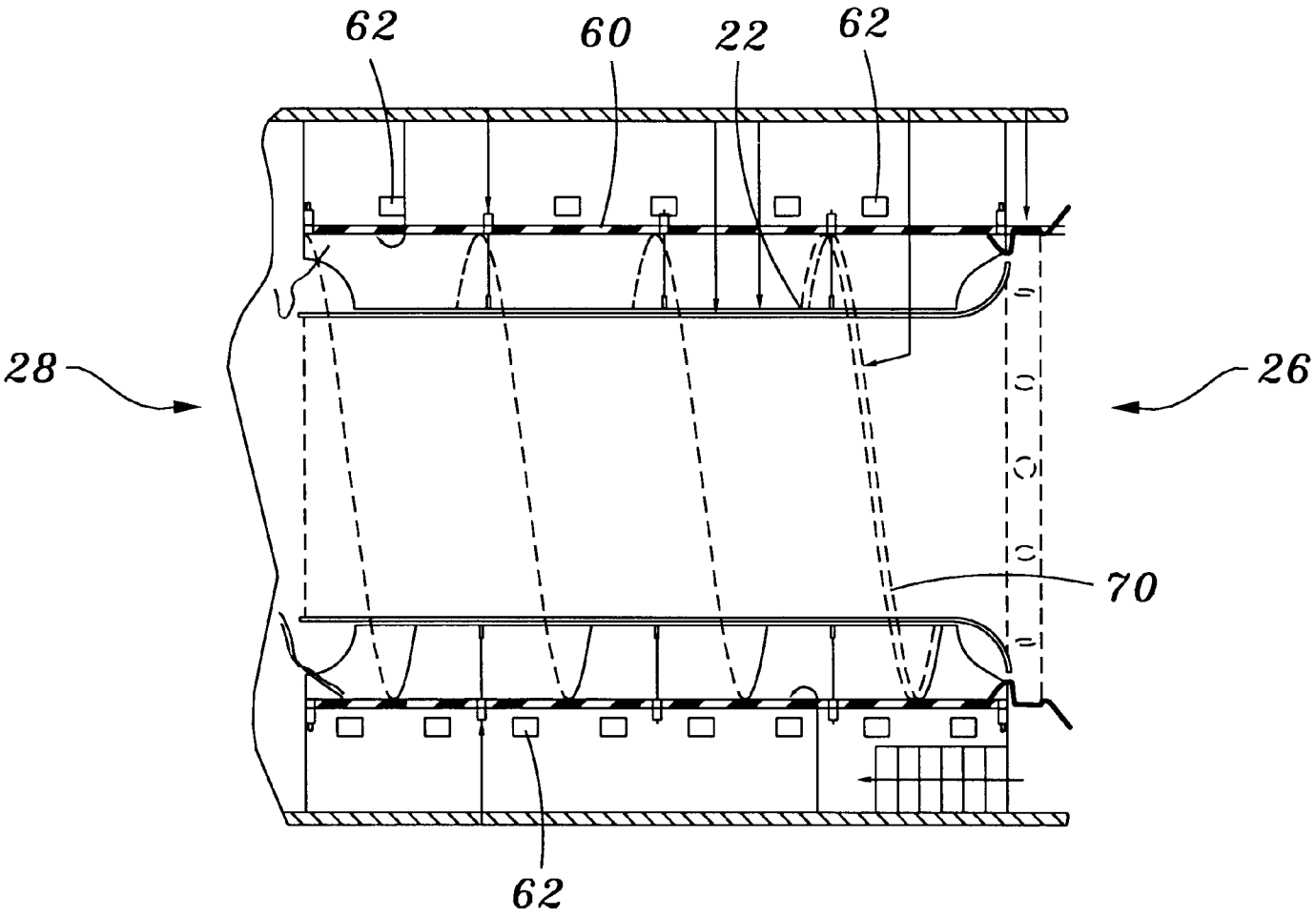
FIG. 4 is a schematically illustrated plan view of an embodiment having transparent walls.

Referring to FIGS. 4 and 5, the entrance 26 of the tunnel 14 is elevated above the exit 28, so that the tunnel 14 is declined at an angle AN in the range of 0–15°, and preferably 5°. As a result, the water 72 streaming around the inside tunnel surface 20 moves in a spiral flow path 70, as shown in FIG. 4, to better replicate a whirlpool. Also as shown in FIG. 4 in an alternative embodiment, a tunnel 60 may be made of a transparent or translucent material, such as glass or plastic, instead of an opaque material, such as fiberglass and/or concrete, as shown in FIG. 3. In this embodiment, lighting fixtures 62 outside of the tunnel 60 project light into the tunnel, through the transparent or translucent tunnel walls, and through the transparent or translucent water vortex 68 within the tunnel, providing a dramatic and aesthetic effect.

After the pumps 34 have been turned on and the water vortex 68 established within the tunnel 14, guests 25 walk through the tunnel on the bridge 16. Alternatively, the guests 25 can move through the tunnel 14 on a moving walkway, people mover, or on a vehicle. After the guests 25 have moved out of the tunnel 14, the pumps 34 may be turned off, or the water may be directed elsewhere.

Figure 10:
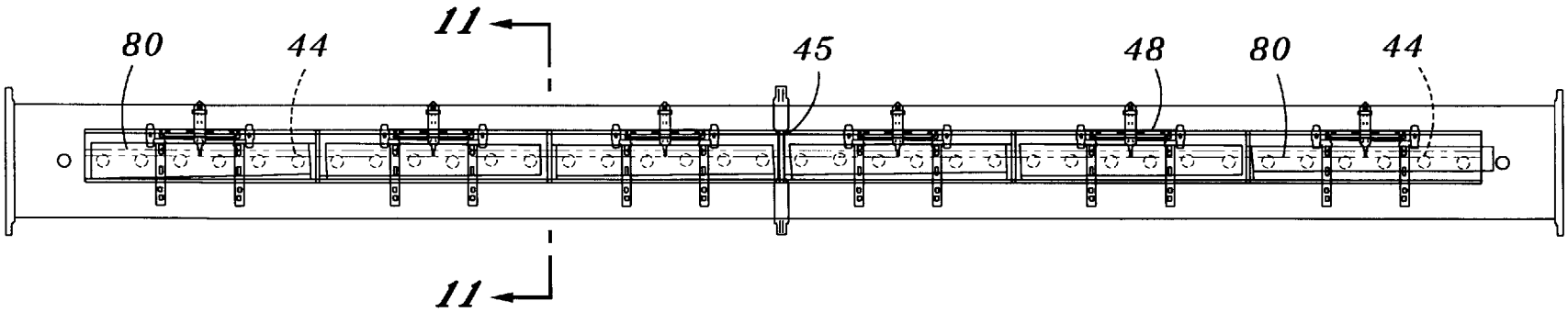
FIG. 10 is a plan view of an alternative manifold embodiment having diverters.
Figure 11:
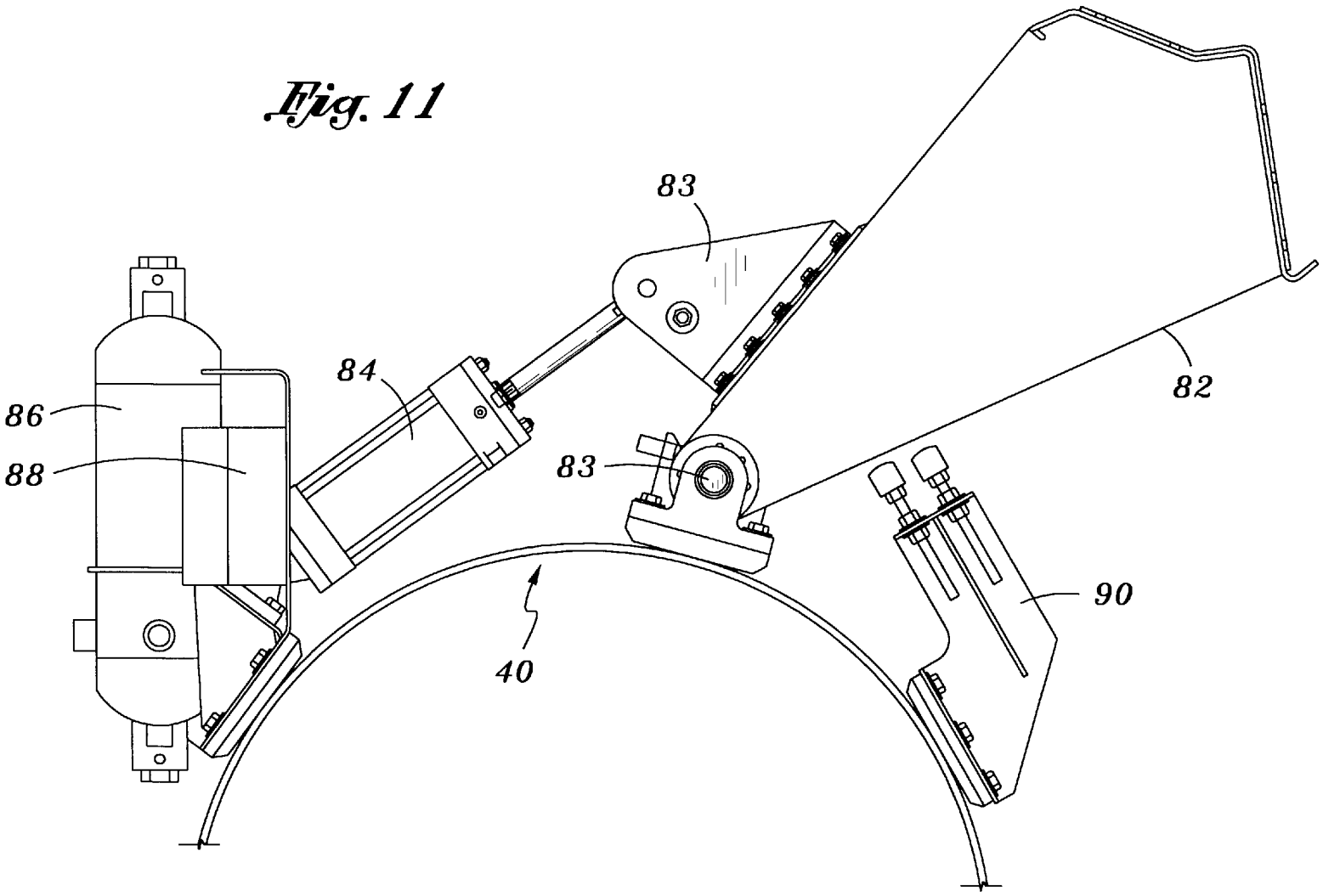
FIG. 11 is a partial section view taken along line 11—11 of FIG. 10.
Figure 12:
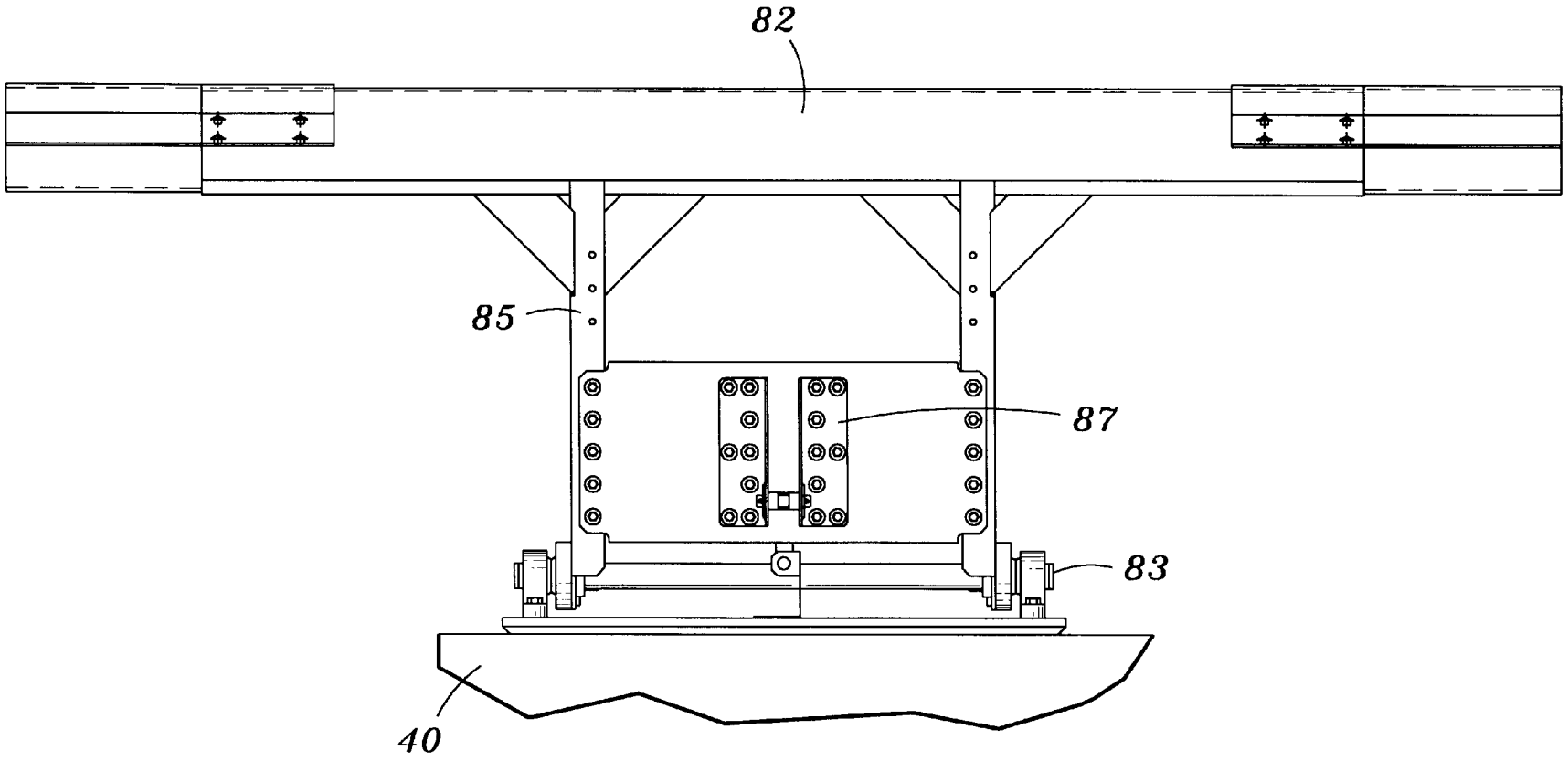
FIG. 12 is a plan view of the diverter shown in FIG. 11.

Referring to FIGS. 10–12, diverters 80 may also be provided on the manifold 40, to quickly shut down the water vortex 68. During an emergency condition, such as a power failure or reduction, pump failure, major leak, etc., if guests 25 are in the tunnel 14, they may get wet as the water vortex 68 collapses around them and onto the bridge 16. The diverters 80 are provided for this contingency.

As shown in FIGS. 10–11, a diverter plate 82 is supported on arms 85 attached to the outside surface of the manifold 40 via pivots 83. A pneumatic actuator 84 attached to the outside of the manifold 40 is joined to an actuator bracket 87 on the plate arms 85. The pneumatic actuator 84 is connected to a compressed air reservoir 86 via an emergency release valve 88.

If an imminent collapse of the water vortex 68 is detected, the emergency release valve 88 is opened. Compressed air from the tanks 86 drives the actuators 84 to immediately move the plates 82 over the nozzles 44. Consequently, water flow into the tunnel is immediately shut off. An adjustable plate stop 90 on the outside of the manifold 40 absorbs the impact of the diverter plate 80 and stops the diverter plate in position over the nozzles 44. The plate 80 is shaped so that after it breaks into the water stream, it is pulled in and centered over the water, and directs the water down and out.

Imminent collapse of the water wave or vortex 68 may be detected via electrical sensors monitoring the pumps 34, or by sensors sensing water pressure or velocity at various locations.

Referring to FIG. 5, when the tunnel 14 is not in use, e.g., when the guests 25 are elsewhere in the attraction 10, the water may be redirected through a bypass pipe 75 back to the reservoir or the pumps 34 may be shut down. Alternatively, if the water 72 is needed elsewhere in the attraction 10, a bypass valve 76 is provided at the lower or exit end of the manifold 40. Similarly, a pump-out valve 74 may be provided at the upper or entrance end of the manifold 40. The bypass pipe 75 connects to the pump out valve 74, and a pump-out pipe 77 connects to the pump-out valve 76, to provide water to other places in the attraction 10. When the tunnel 14 is in use and the water vortex 68 is established, the bypass valve 74 and pump-out valve 76 are closed, so that the manifold 40 delivers maximum water volume and pressure to the tunnel 14. At other times, either the bypass valve 74, or the pump-out valve 77, or both, may be opened to provide water to other locations. When either or both valves 74 and 76 are partially or fully open, a controlled amount of water will still flow out of the nozzles 44. For example, with the valve 74 partially open, the water may crash down on the walkway 16 while the guests are watching (before they walk through), to provide a more thrilling attraction. The valves 74 and 76 may also be opened to collapse the water vortex 68, at appropriate times. Use of the valves 74 and 76 allows the pumps to run continuously, thereby avoiding delays associated with pump start-up, or other adverse hydraulic effects.

As shown in FIGS. 1 and 3, the tunnel 14 is preferably configured so that the guests 25 can reach out and actually touch the water vortex or whirlpool 68. In an alternative embodiment, shown in phantom and solid lines in FIG. 6, a screen 100 or other obstruction may be placed in the nozzle to disturb the flow of water, thus adding air into the water and making the water opaque, as opposed to free flowing and relatively transparent water out flow from the nozzles shown in solid lines in FIG. 6.

In another alternative embodiment, the inside surface of the tunnel may be made rough, to disturb the water flow and change its visual appearance. Baffle plates 102, i.e., plates with through holes may also be incorporated into the inside surface of the tunnel, to create the same effect. The flow within the tunnel can be locally effected by changing the inside surface texture of the tunnel.

The attraction 10 creates a realistic, aesthetic, and entertaining experience for theme park guests. The invention may also be used in other applications requiring a water whirlpool or vortex, e.g., during motion picture filming, television program production, still photography, etc.

Many insubstantial changes may be made to the designs illustrated and explained above. For example, the semi-cylinder tunnel may be replaced up to a fall 360° cylinder or a cylinder shape that is more elliptical than round. The individual nozzles may be replaced with a single and equivalent manifold opening. The bridge 16 may be shifted vertically or horizontally within the tunnel, or replaced with another way for allowing guests to move through the tunnel.

The drawings are intended to accurately show the various described components in proportion to their actual preferred dimensions and positions. The dimensions can of course be changed to suit a particular use.

Thus, a novel attraction and water vortex or whirlpool effect has been shown and described. Various modifications may, of course, be made without departing from the spirit and scope of the invention. Accordingly, the invention should not be limited, except to the following claims, and their equivalents.

What is claimed is:

1. An attraction comprising:

a tunnel having a curved inside surface and a first end and a second end wherein the first end is elevated above the second end;

a platform in the tunnel; and a plurality of nozzles positioned to shoot water onto the curved inside surface at a velocity sufficiently high so that the water moves along against the curved inside surface.

2. The attraction of claim 1 further comprising water lines connected to the nozzles; and a pump connected to the water lines.

3. The attraction of claim 2 wherein the plurality of water lines comprise a water manifold below the walkway, and a multiplicity of nozzles on the water manifold.

4. The attraction of claim 3 further comprising a baffle within the manifold.

5. The attraction of claim 2 further comprising a handrail extending along the walkway, and lighting fixtures in the handrail oriented to shine light downwardly toward the walkway and outwardly toward the tunnel walls.

6. The attraction of claim 2 wherein the platform is spaced apart from the inside surface of the tunnel on all sides.

7. The attraction of claim 2 wherein the tunnel extends over an angle of from 180–270 degrees.

8. The attraction of claim 2 wherein the tunnel has a length to diameter ratio of from 1:1 to 20:1.

9. The attraction of claim 8 wherein the semi-cylinder has a length to diameter ratio of 5:1.

10. The attraction of claim 2 wherein the tunnel is translucent or transparent.

11. The attraction of claim 2 wherein the plurality of water lines comprise a plurality of supply pipes extending from a reservoir to a manifold section, and a nozzle on each manifold section.

12. The attraction of claim 11 wherein each manifold section is separated by a baffle.

13. The attraction of claim 2 further comprising an adjuster associated with each nozzle, for aiming the nozzle at the first side of the inside surface of the semi-cylinder.

14. The attraction of claim 2 further comprising a manifold connected between the pump and the plurality of water lines, and a bypass valve connected to the manifold and to a bypass pipe, to allow the pump to continue to operate, without pumping water into the semi-cylinder.

15. The attraction of claim 1 further comprising first and second gutters at the first and second ends of the tunnel.

16. A method of creating a special effect using water, comprising the steps of:

positioning a walkway within a semi-cylinder having a downward-facing curved inside surface extending from a first side to a second side, and with a first end of the semi-cylinder raised above a second end thereof, positioning spray nozzles below the walkway; and pumping water through the spray nozzles so that the water forms a flowing water layer on the downward-facing curved inside surface of the semi-cylinder, with the water layer remaining against the downward-facing curved inside surface from the first side to the second side thereof, via centrifugal force.

17. The method of claim 16 further comprising the step of causing the water layer to move in a spiral path along the inside surface of the semi-cylinder, by raising one end of the semi-cylinder.

18. An amusement park attraction comprising:

a downward facing semi-cylinder having a curved inside surface extending from a first side to a second side, over an arc of at least 180 degrees, wherein the semi-cylinder has a first end and a second end and the first end is elevated above the second end;

a walkway extending through the tunnel for people to walk on;

a plurality of water lines oriented to spray water onto the first side of the curved inside surface; and a pump connected to the plurality of water lines, the pump capable of pumping water through the water lines fast enough so that the water sprayed out of the water lines moves along the inside surface, under centrifugal force, from the first side to the second side.

19. An amusement park attraction comprising:

a downward facing semi-cylinder having a curved inside surface extending from a first side to a second side, over an arc of at least 180 degrees, wherein the semi-cylinder has a first end and a second end;

a first gutter extending inwardly into the first end of the semi-cylinder, to divert any dripping water;

a second gutter extending inwardly into the second end of the semi-cylinder, to divert any dripping water;

a walkway extending through the tunnel for people to walk on;

a plurality of water lines oriented to spray water onto the first side of the curved inside surface; and a pump connected to the plurality of water lines, the pump capable of pumping water through the water lines fast enough so that the water sprayed out of the water lines moves along the inside surface, under centrifugal force, from the first side to the second side.

* * * * *